US011742610B2

(12) United States Patent
Chang et al.

(10) Patent No.: US 11,742,610 B2
(45) Date of Patent: Aug. 29, 2023

(54) ELECTRIC CONNECTOR WITH UNLATCHING MECHANISM

(71) Applicant: JESS-LINK PRODUCTS CO., LTD., New Taipei (TW)

(72) Inventors: Hsu-Feng Chang, New Taipei (TW); Ya-Fen Kao, New Taipei (TW); Cheng-Chung Lai, New Taipei (TW); Siang-Ting Wang, New Taipei (TW)

(73) Assignee: JESS-LINK PRODUCTS CO., LTD., New Taipei (TW)

( * ) Notice: Subject to any disclaimer, the term of this patent is extended or adjusted under 35 U.S.C. 154(b) by 28 days.

(21) Appl. No.: 17/556,366

(22) Filed: Dec. 20, 2021

(65) Prior Publication Data

US 2023/0155315 A1 May 18, 2023

(30) Foreign Application Priority Data

Nov. 17, 2021 (TW) ..... 110142760

(51) Int. Cl.
*H01R 13/506* (2006.01)
*H01R 12/71* (2011.01)

(52) U.S. Cl.
CPC ..... *H01R 13/506* (2013.01); *H01R 12/712* (2013.01)

(58) Field of Classification Search
None
See application file for complete search history.

(56) References Cited

U.S. PATENT DOCUMENTS

| | | | | |
|---|---|---|---|---|
| 10,461,473 | B1 * | 10/2019 | Hsiao | H01R 13/6335 |
| 10,770,836 | B2 * | 9/2020 | Henry | H01R 13/6272 |
| 10,855,028 | B1 * | 12/2020 | Henry | H01R 13/6272 |
| 11,303,065 | B2 * | 4/2022 | Wang | H01R 12/71 |
| 11,417,988 | B1 * | 8/2022 | Chang | H01R 12/59 |
| 2020/0076123 | A1 * | 3/2020 | Yang | H01R 13/506 |
| 2020/0366019 | A1 * | 11/2020 | Hsiao | H01R 12/774 |
| 2021/0367379 | A1 * | 11/2021 | Cao | H01R 13/6335 |

FOREIGN PATENT DOCUMENTS

TW M624826 U 3/2022

OTHER PUBLICATIONS

Office Action dated Nov. 3, 2022 of the corresponding Taiwan patent application No. 110142760.

* cited by examiner

*Primary Examiner* — Oscar C Jimenez
(74) *Attorney, Agent, or Firm* — Chun-Ming Shih; HDLS IPR SERVICES

(57) ABSTRACT

The disclosure provides an electric connector, which includes a base, a cover, and an elastic member. The cover covers the base and is formed with a chamber. The cover is disposed with a key and a trough. The elastic member is disposed in the chamber and includes a lower plate, an upper plate, and a flexible arm. The lower plate is fixed on the base. The upper plate is formed above the lower plate. The flexible arm is connected between the lower plate and the upper plate. The upper plate is extended with a hook. The hook movably enters or leaves each trough. The upper plate is disposed with a pressed portion corresponding to the key in position. The pressed portion drives each hook to move out from each trough through pressing of the key so as to implement unlatching of the electric connector.

8 Claims, 8 Drawing Sheets

ELECTRIC CONNECTOR WITH UNLATCHING MECHANISM

BACKGROUND

Technical Field

The disclosure relates to an electric connector, particularly to an electric connector with an unlatching mechanism.

Description of Related Art

Some electric connectors are provided with a movable hook on its male connector. When connecting a female connector, the male connector is hooked to the female connector by the hook so as to make a firm connection to avoid separation.

However, the electric connector with a hooking function still has some problems in usage. Because the structure is relatively complicated, the problem is not only the components being difficult to be assembled, but also the relatively high processing costs of the components.

In view of this, the inventors have devoted themselves to the above-mentioned related art, researched intensively and cooperated with the application of science to try to solve the above-mentioned problems.

SUMMARY

An object of the disclosure is to provide an electric connector with an unlatching mechanism, which effectively simplify the overall structure to accomplish easy assembling and low costs.

To accomplish the above object, the disclosure provides an electric connector with an unlatching mechanism, which includes a base, a cover, and an elastic member. The base includes an insulative seat, a circuit board, and a cable. An end of the circuit board and an end of the cable are embedded in the insulative seat. The circuit board has multiple printed terminals. The cable is electrically connected with each printed terminal. The cover covers the base. A chamber is defined between the insulative seat and the cover. The cover is disposed with a key and a trough, and the trough is respectively located on two sides of the key and communicates with the chamber. The elastic member is received in the chamber and includes a lower plate, an upper plate and at least one flexible arm. The lower plate is fixed on the insulative seat. The upper plate is formed above the lower plate. The flexible arm is connected between the lower plate and the upper plate. Each of two ends of the upper plate is extended with a hook. Each hook movably enters or leaves each trough. The upper plate is disposed with a pressed portion corresponding to the key in position. The pressed portion drives each hook to move out from each trough through the pressing of the key to unlatch the electric connector.

The disclosure further has the following functions. The base and the cover are connected by melting to save screwing time in the related art. Regardless of using the key or the pulling belt assembly, the flexible arms are used for restoring the structure to initial status, and thus the overall structure of the elastic member is simplified.

DETAILED DESCRIPTION

Figure 1:
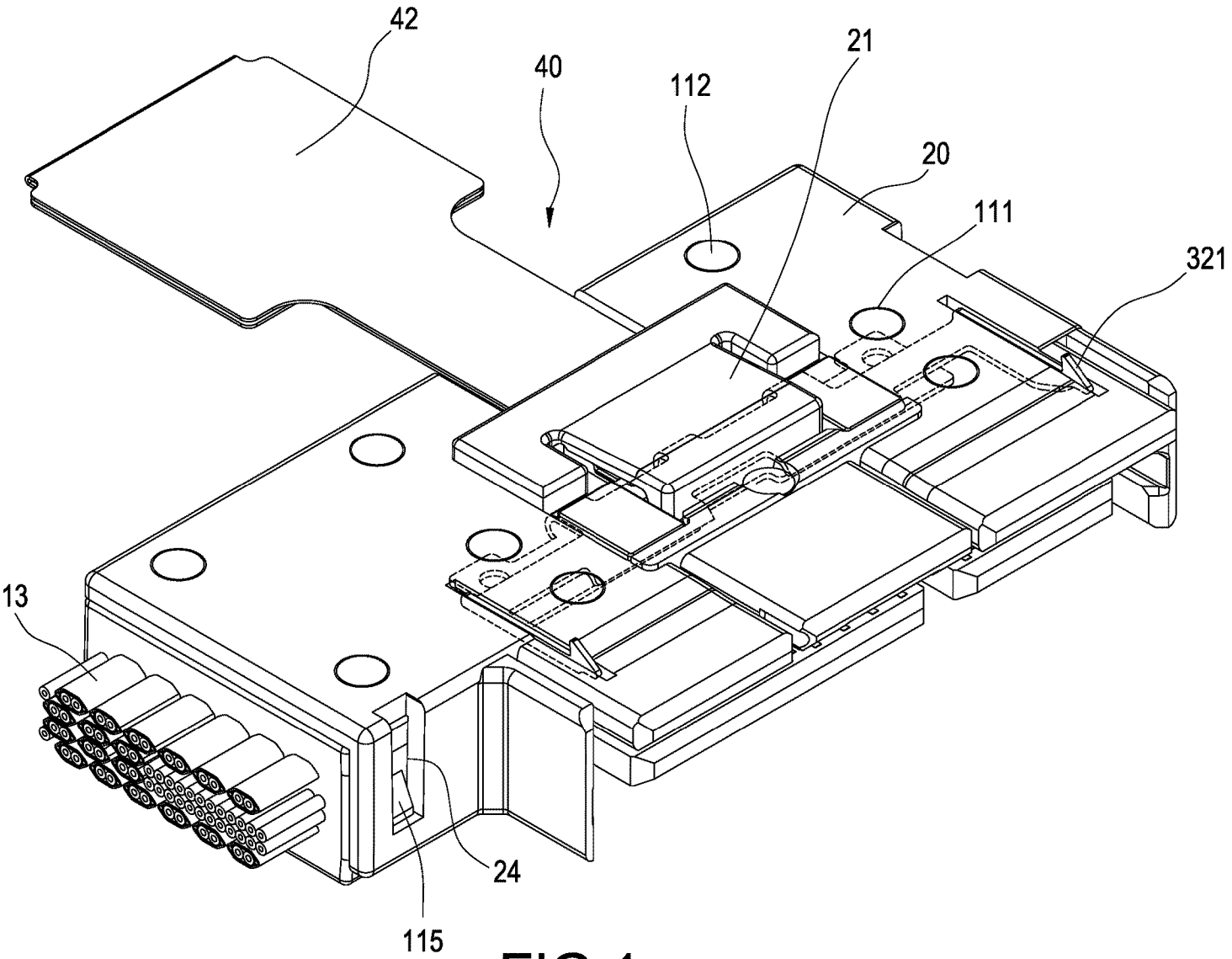
FIG. 1 is a perspective assembled view of the electric connector of the disclosure.
Figure 2:
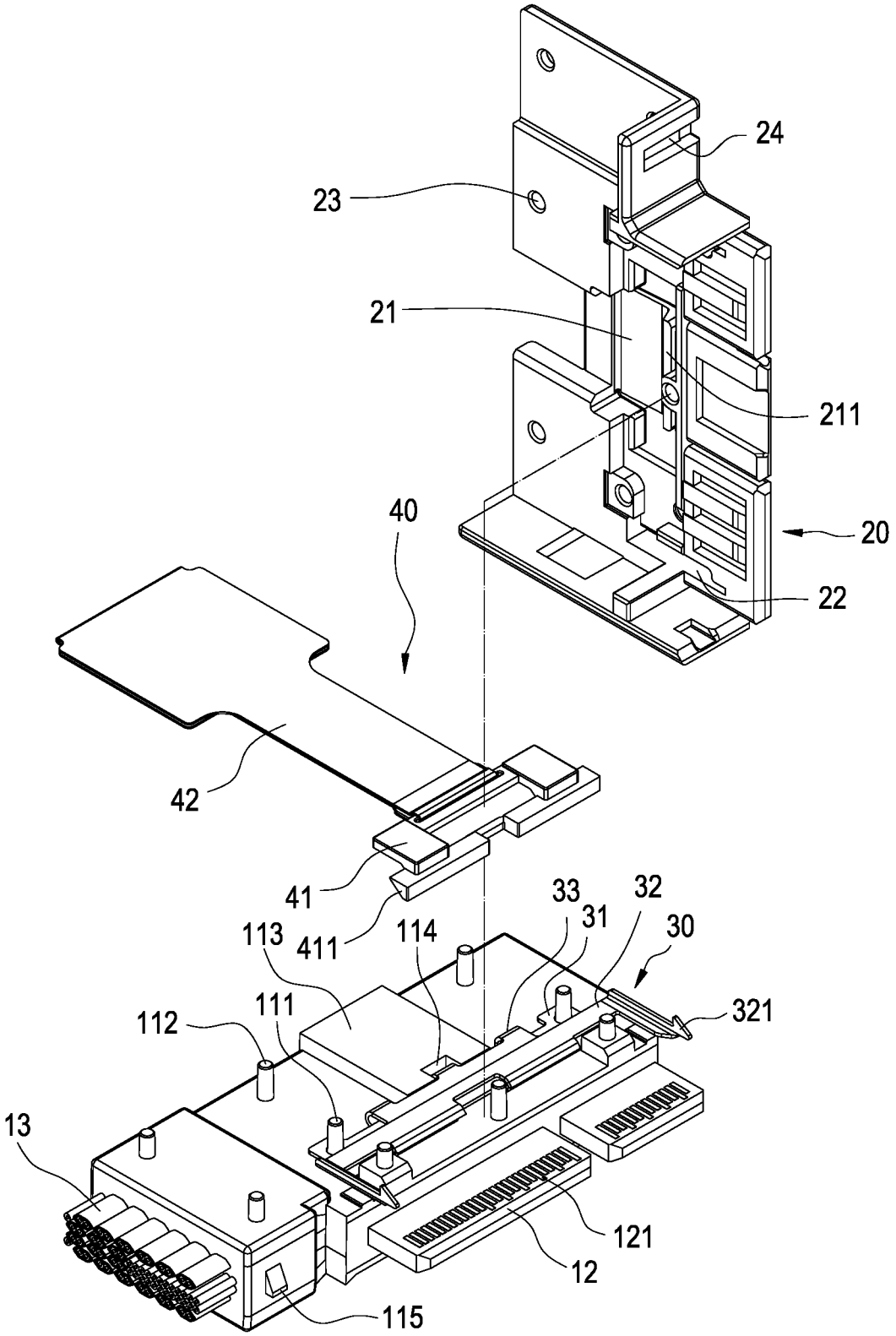
FIG. 2 is a perspective exploded view of the electric connector of the disclosure.
Figure 3:
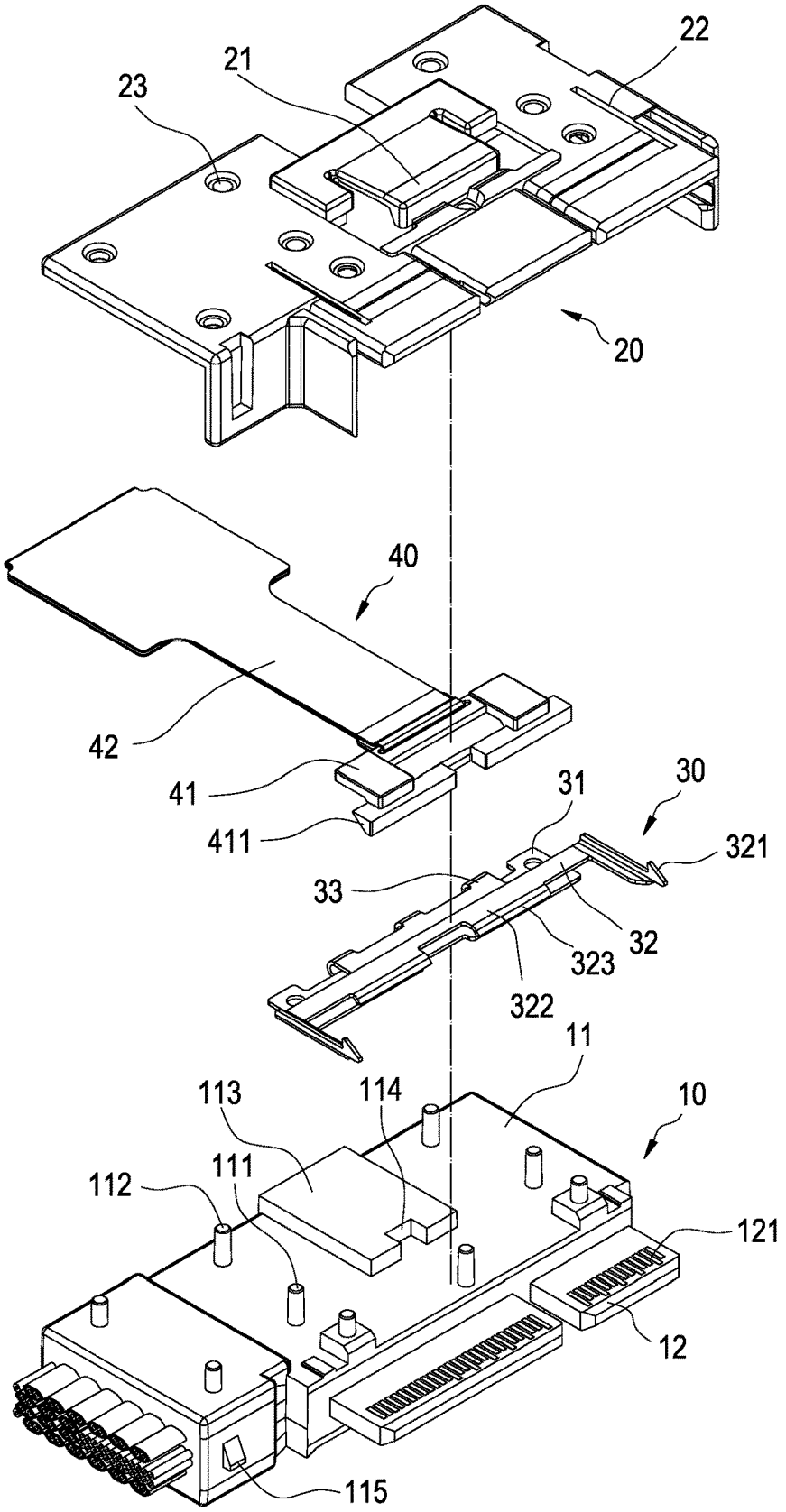
FIG. 3 is an exploded view of the elastic member separating from the insulative seat.
Figure 4:
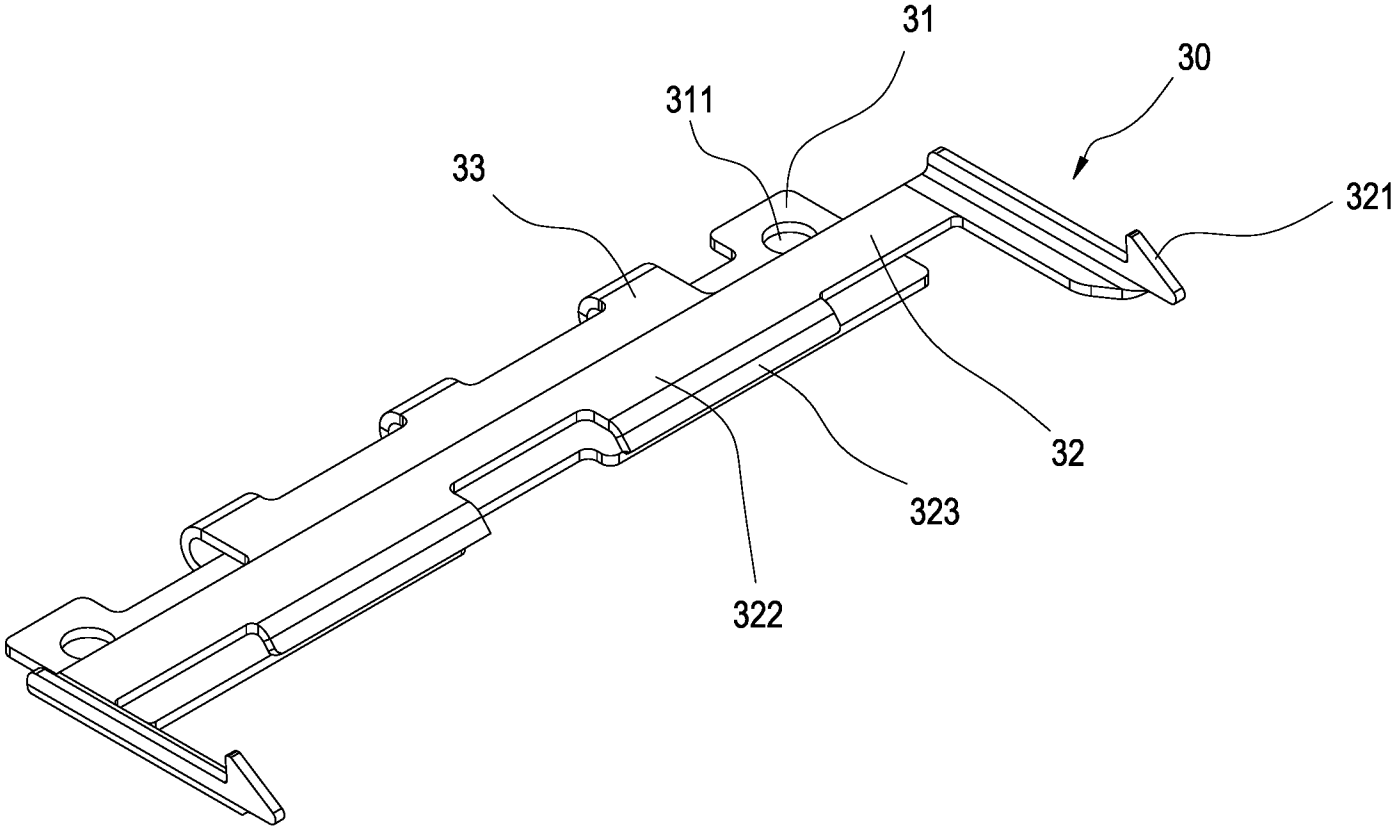
FIG. 4 is a perspective view of the elastic member of the disclosure.
Figure 5:
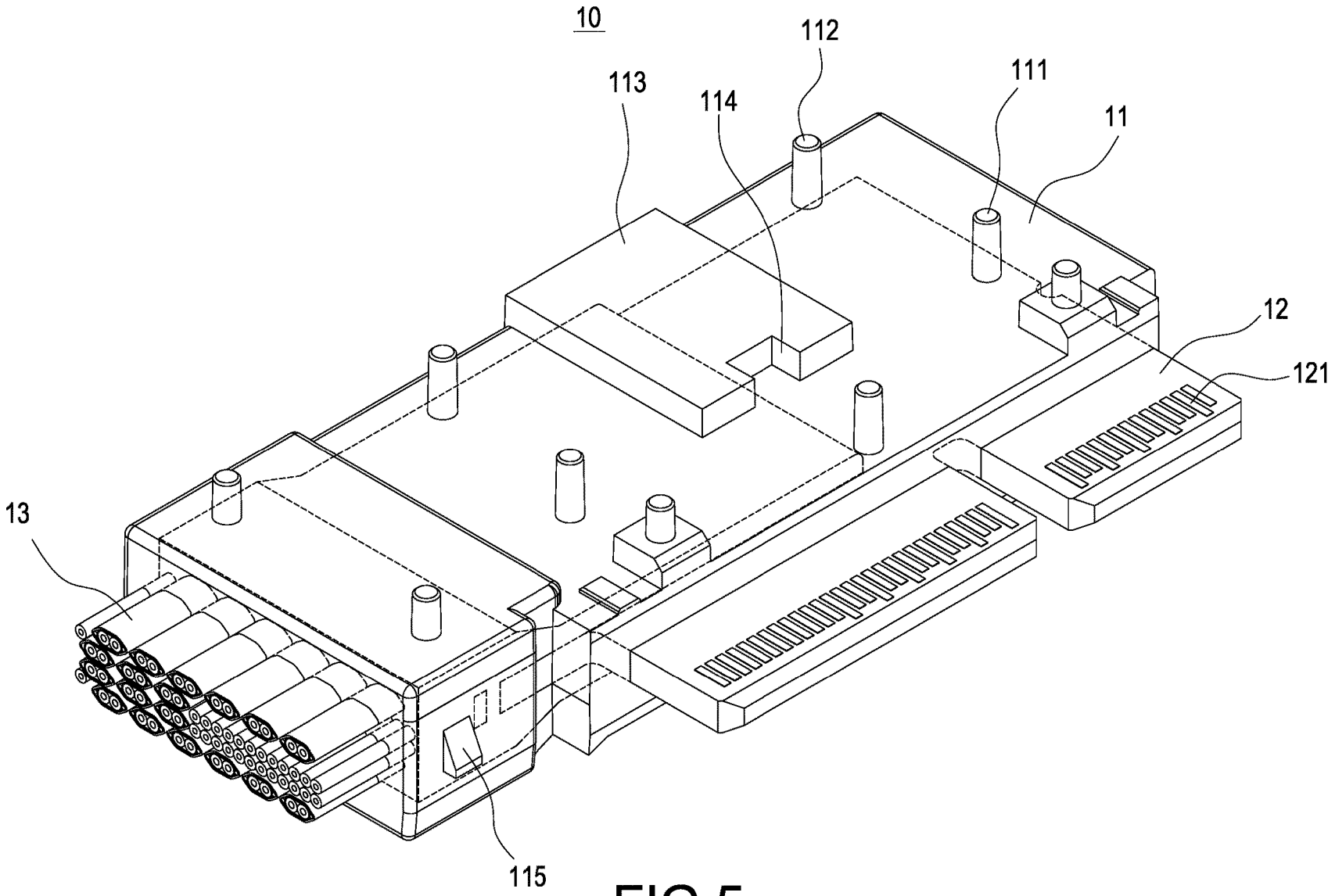
FIG. 5 is a perspective view of the base of the disclosure.

The technical contents of this disclosure will become apparent with the detailed description of embodiments accompanied with the illustration of related drawings as follows. It is intended that the embodiments and drawings disclosed herein are to be considered illustrative rather than restrictive.

Please refer to FIGS. 1-5. The disclosure provides an electric connector with an unlatching mechanism, which includes a base 10, a cover 20 and an elastic member 30.

The base 10 includes an insulative seat 11, a circuit board 12 and a cable 13. An end of the circuit board 12 and an end of the cable 13 are embedded in the insulative seat 11. An area of the circuit board 12, which is not covered by the insulative seat 11 and is far away from the insulative seat 11, has multiple printed terminals 121. The cable 13 is composed of multiple core wires. Each core wire is separately electrically connected to the printed terminals 121 by a printed circuit (not shown in figures) of the circuit board 12.

In an embodiment, the top of the insulative seat 11 is upward extended with multiple positioning bars including two first positioning bars 111 and seven second positioning bars 12. The first positioning bars 111 and the second positioning bars 12 are arranged spacedly. A portion of the insulative seat 11, which is between the first positioning bars 111 and the second positioning bars 112, is provided with a platform 113. The front middle of the platform 113 is formed with a recess 114. Each of lateral sides of the insulative seat 11 is formed with multiple latching blocks 115.

Figure 6:
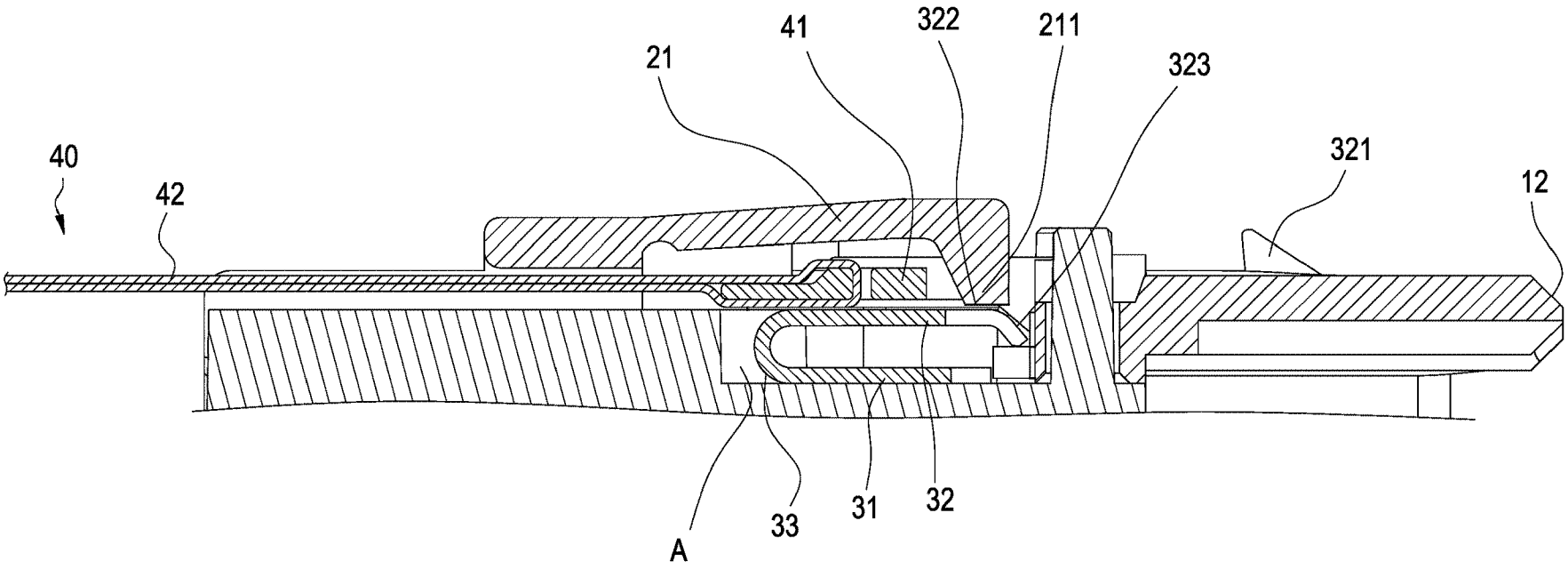
FIG. 6 is a cross-sectional view of the electric connector of the disclosure in use.

The cover 20 covers the base 10. A chamber A is formed between the insulative seat 11 and the cover 20 as shown in FIG. 6. The middle of the cover 20 is disposed with a key 21. A trough 22 is respectively disposed on two sides of the key 21 (that is, two trough 22 on each side) with a proper distance from the key 21 and communicates with the chamber A. An end of the key 21 on the side toward the insulative seat 11 is provided with a pressing block 211.

In an embodiment, the cover 20 is disposed with multiple through holes 23. Each through hole 23 is correspondingly passed by each first positioning bar 111 and each second positioning bar 112, and each first positioning bar 111 and each second positioning bar 112 are treated with melting to make the cover 20 be firmly connected with the insulative seat 11. The cover 20 is further disposed with multiple latching slots 24 separately corresponding to each latching block 115 in position so as to make the cover 20 and the insulative seat 11 be connected with each other.

The elastic member 30 is received in the chamber A and includes a lower plate 31, an upper plate 32 and at least one flexible arm 33. The upper plate 32 and the lower plate 33 are of a flat strip shape. The flexible arm 33 is of a U-shape. Two ends of the lower plate 31 are respectively formed with a positioning hole 311. Each positioning hole 311 is passed by each first positioning bar 111 to fix the lower plate 31 on the insulative seat 11.

The upper plate 32 is formed above the lower plate 31 and is substantially parallel with the lower plate 31. Two ends of the upper plate 32 are respectively extended with a hook 321. Each hook 321 is parallel to each other and perpendicular to the upper plate 32. Each hook 321 movably enters or leaves each trough 22. The upper plate 32 is disposed with a pressed portion 322 corresponding to the key 21 in position. Also, the front edge of the upper plate 32 is downward extended with a pressed slant 323.

The flexible arm 33 is connected between the lower plate 31 and the upper plate 32. The flexible arm 33 of the embodiment is, but not limited to, three in number. The flexible arm 33 in the middle is correspondingly engaged with the recess 114. Each flexible arm 33 and each hook 321 are extended from the upper plate 32 toward opposite directions.

Figure 7:
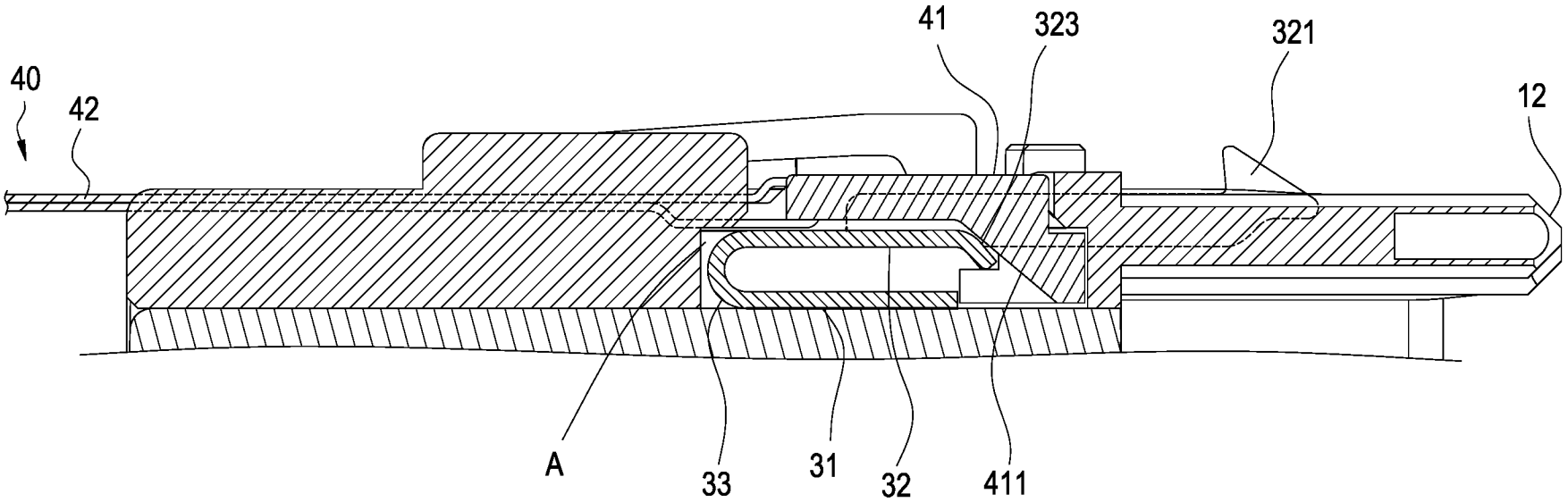
FIG. 7 is another cross-sectional view of the electric connector of the disclosure in use.

In an embodiment, the electric connector of the disclosure further includes a pulling belt assembly 40 disposed in the chamber A and projecting to outside of the base 10 and cover 20. The pulling belt assembly 40 includes an actuator 41 and a pulling belt 42. The actuator 41 is disposed in the chamber A. The lower side of the actuator 41 has a pressing slant 411. The pressing slant 411 operatably presses the pressed slant 323 as shown in FIG. 7. An end of the pulling belt 42 is connected to the actuator 41, attached on the top of the platform 113 and further extended to outside of the base 10 and the cover 20.

Please refer to FIG. 6. When using, the pressed portion 322 of the upper plate 32 is pressed by the pressing block 211 through the pressing of the key 21 to make the upper plate 32 be downward bent and slanted so as to drive each hook 321 to move out from each trough 22. At the same time, a connector (not shown in figures) connected to the electric connector may be taken out to unlatch the electric connector. On the contrary, after releasing the key 21, the upper plate 32 and each hook 321 may return to the initial status through the elastic deformation of each flexible arm 33.

Figure 8:
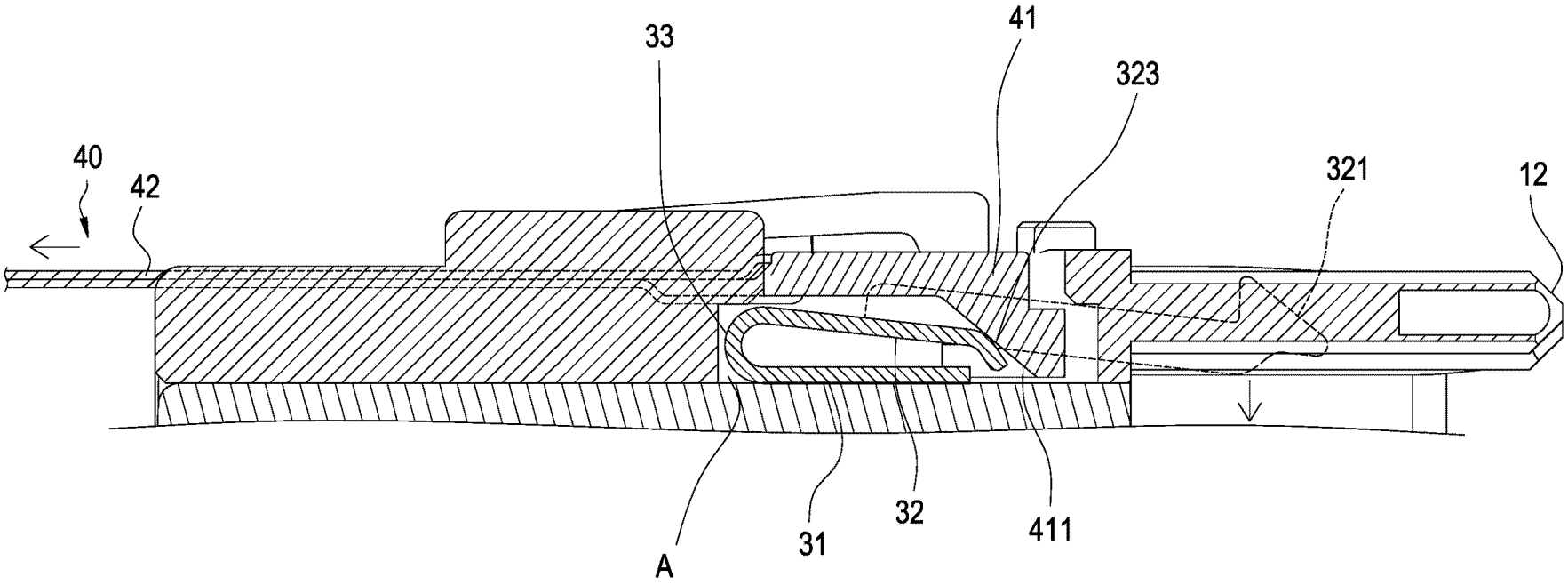
FIG. 8 is still another cross-sectional view of the electric connector of the disclosure in use.

Please refer to FIGS. 7 and 8. Apart from the above operation, the electric connector of the disclosure may also implement unlatching by the operating of the pulling belt assembly 40. When using, the pulling belt 42 is pulled to move away from the elastic member 30, and the pressing slant 411 of the actuator 41 presses the pressed slant 323 to make the upper plate 32 be downward bent and slanted so as to drive each hook 321 to move out of each trough 22 to unlatch the electric connector.

While this disclosure has been described by means of specific embodiments, numerous modifications and variations could be made thereto by those skilled in the art without departing from the scope and spirit of this disclosure set forth in the claims.

What is claimed is:

1. An electric connector with an unlatching mechanism, the electric connector comprising:

a base, comprising an insulative seat, a circuit board, and a cable, wherein an end of the circuit board and an end of the cable are embedded in the insulative seat, the circuit board comprises multiple printed terminals, and the cable is electrically connected with each printed terminal;

a cover, covering the base, a chamber defined between the insulative seat and the cover, a key disposed on the cover, and a trough respectively disposed on two sides of the key and communicating with the chamber;

an elastic member, received in the chamber and comprising a lower plate, an upper plate and at least one flexible arm, the lower plate fixed on the insulative seat, the upper plate disposed above the lower plate, the flexible arm connected between the lower plate and the upper plate, a hook respectively extended from two ends of the upper plate, each hook movably entering or leaving each trough, and a pressed portion disposed on the upper plate corresponding to the key in position; and a pulling belt assembly, disposed in the chamber and projecting to outside of the base and cover;

wherein the pressed portion is configured to drive each hook to move out of each trough through pressing of the key to unlatch the electric connector;

wherein the insulative seat comprises a platform, the pulling belt assembly comprises an actuator and a pulling belt, the actuator is disposed in the chamber, and an end of the pulling belt is connected to the actuator and attached on a top of the platform and further extended to outside of the base and the cover.

2. The electric connector of claim 1, wherein the insulative seat comprises multiple positioning bars extended therefrom, multiple through holes are defined on the cover, each through hole is correspondingly passed by each positioning bar, and each positioning bar is treated with melting.

3. The electric connector of claim 1, wherein the insulative seat comprises multiple positioning bars extended therefrom, multiple positioning holes are defined on the lower plate, each positioning hole is passed by each positioning bar to make the lower plate be fixed on the insulative seat.

4. The electric connector of claim 1, wherein a recess is disposed on the platform, the flexible arm is multiple in number, and one of the flexible arms is correspondingly fastened in the recess.

5. The electric connector of claim 1, wherein the upper plate is substantially parallel with the lower plate, and each flexible arm and each hook are extended from the upper plate toward opposite directions.

6. The electric connector of claim 1, wherein the insulative seat comprises multiple latching blocks, and the cover comprises multiple latching slots separately engaging with each latching block.

7. The electric connector of claim 1, wherein the key comprises a pressing block, and the key is configured to press the pressed portion through the pressing block.

8. The electric connector of claim 1, wherein the upper plate comprises a pressed slant, the actuator comprises a pressing slant, after the pulling belt assembly being pulled, the pressing slant presses the pressed slant to make each hook move out from each trough to unlatch the electric connector.

* * * * *